US006287073B1

(12) United States Patent
Lindgren et al.

(10) Patent No.: US 6,287,073 B1
(45) **Date of Patent: *Sep. 11, 2001**

(54) DETACHABLE SUPPORT FRAME FOR HOLDING A PAIR OF LATERALLY ADJUSTABLE LOAD-CARRYING FORKS

(75) Inventors: Gunnar Lindgren; Daniel Back, both of Eskilstuna; Håkan Ripell, Skogstorp, all of (SE)

(73) Assignee: Volvo Wheel Loaders AB (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/284,078

(22) PCT Filed: Oct. 7, 1997

(86) PCT No.: PCT/SE97/01673

§ 371 Date: May 6, 1999

§ 102(e) Date: May 6, 1999

(87) PCT Pub. No.: WO98/15490

PCT Pub. Date: Apr. 16, 1998

(30) Foreign Application Priority Data

Oct. 7, 1996 (SE) ..... 9603655

(51) Int. Cl.[7] ..... B66F 9/14

(52) U.S. Cl. ..... 414/785; 414/544; 414/608; 414/667

(58) Field of Search ..... 414/785, 667, 414/920, 912, 607, 608, 619, 620, 621, 622, 544; 187/222, 237

(56) References Cited

U.S. PATENT DOCUMENTS

| | | | | |
|---|---|---|---|---|
| 2,847,138 | * | 8/1958 | Backofen et al. | 414/785 |
| 3,356,241 | * | 12/1967 | Varilek | 414/785 X |
| 3,429,470 | | 2/1969 | Melin | 414/785 |
| 3,966,064 | * | 6/1976 | Felburn | 414/920 X |
| 3,982,647 | | 9/1976 | Teutsch | 414/785 |
| 4,024,973 | * | 5/1977 | Siderits et al. | 414/785 X |
| 4,113,128 | | 9/1978 | Foss . | |
| 4,280,781 | * | 7/1981 | Bodin | 414/785 X |
| 4,335,992 | * | 6/1982 | Reeves | 414/667 |
| 4,342,377 | * | 8/1982 | Goodwin | 414/785 X |
| 4,355,947 | * | 10/1982 | Wiblin | 414/785 |
| 4,392,773 | * | 7/1983 | Johannson | 414/667 |
| 4,395,188 | * | 7/1983 | Kaup | 414/785 X |
| 4,488,832 | * | 12/1984 | Kinshofer | 414/607 X |
| 4,640,662 | * | 2/1987 | Spellman | 414/920 X |
| 5,336,039 | * | 8/1994 | House | 414/667 X |
| 5,338,148 | | 8/1994 | Ronnblom | 414/667 |
| 5,374,156 | * | 12/1994 | Simpson et al. | 414/785 X |
| 5,509,774 | * | 4/1996 | Yoo | 414/622 |

FOREIGN PATENT DOCUMENTS

| | | | |
|---|---|---|---|
| 27 16 704 | 10/1978 | (DE) . | |
| 29 35 553 | 3/1981 | (DE) . | |
| 0 628 511 | 12/1994 | (EP) | 414/621 |
| 2213229 | 8/1974 | (FR) . | |

* cited by examiner

*Primary Examiner*—Robert P. Olszewski
*Assistant Examiner*—Gerald J. O'Connor
(74) *Attorney, Agent, or Firm*—Kilpatrick Stockton LLP

(57) ABSTRACT

The lift fork rack includes a first beam, a second beam and at least two spacer elements which fix the first and second beams at a distance from and substantially parallel to each other. The load-bearing fork members can be mounted on the first and second beams. The fork members can be displaced along the length of the beams. The spacer elements have fastening devices which are intended to releasably fasten the lift fork rack to a lift mechanism, the upper beam has a web and a flange which are joined to each other at an angle α different from 90°. The upper beam is joined to each spacer element via the web. The web is directed away from the lower beam.

23 Claims, 5 Drawing Sheets

DETACHABLE SUPPORT FRAME FOR HOLDING A PAIR OF LATERALLY ADJUSTABLE LOAD-CARRYING FORKS

BACKGROUND OF THE INVENTION

The present invention relates to a lift fork rack, comprising an upper beam, a lower beam and at least two spacer elements, which fix the upper and lower beams at a distance from and essentially parallel to each other, load-bearing fork members being mountable on the upper and lower beams, said fork members being displaceable along, the length of the beams, said spacer elements comprising attachment means which are intended to releasably attach the lift fork rack to a lift mechanism. The invention also relates to a fork intended to be mounted on a lift fork rack, comprising first and second legs, which form essentially a right angle to each other, said first leg having coupling means for coupling together with a first and a second beam of the lift fork rack, said second leg having a load surface for carrying a load.

DESCRIPTION OF THE RELATED ART

Lift fork racks of this type are previously known and are used to fix the forks at a predetermined distance from each other. The lift fork rack comprises anchoring means making it possible to fix the lift fork rack to the lift mechanism of e.g,. a wheel loader or a fork lift truck. In order to adjust the fork members to various objects to be lifted, the fork members are laterally displaceable along the lift fork rack.

When the known lift fork rack is mounted on the lift mechanism of a wheel loader, however, the upper and lower beams of the lift fork rack block the sight of the operator making it difficult for him to aim at and then insert the fork members under the object to be lifted as well as placing the object at its intended location. If the distance set between the fork members is small, the upright sections of the fork members will also block the sight of the operator.

A lift fork rack is subjected to repeatedly varying, loads, which means that the material in the lift fork rack may be subject to metal fatigue. At the joints between the beams and the spacers the risk is greatest for fatigue cracking.

SUMMARY OF THE INVENTION

The purpose of the present invention is to achieve a lift fork rack and a fork member of the type described by way of introduction which provides a large field vision for an operator when the lift fork rack is mounted on the lift mechanism of the vehicle.

Another purpose of the present invention is to achieve a lift fork rack which has high fatigue strength.

An additional purpose of the present invention is to achieve a lift fork rack which permits loading and unloading of an object on an inclined surface.

This is achieved according to the invention by virtue of the fact that the upper beam has a web and a flange which are joined to each other at an angle $\alpha$ differing from 90°, that the upper beam is joined to each spacer element via the web, and that the web is directed away from the lower beam.

By making the web of the first beam inclined, the flange will be displaced downwards towards the lower beam. This means that the operator will be better able to see the fork members mounted on the rack when the lift mechanism is in its lower position.

According to one embodiment, the fork members are displaceable relative to the coupling means, which connect the fork members to the lift fork rack, to permit loading and unloading on inclined surfaces.

BRIEF DESCRIPTION OF THE DRAWING

The invention will be described in more detail below with reference to examples shown in the accompanying drawings, where.

DESCRIPTION OF THE PREFERRED EMBODIMENT

Figure 1:
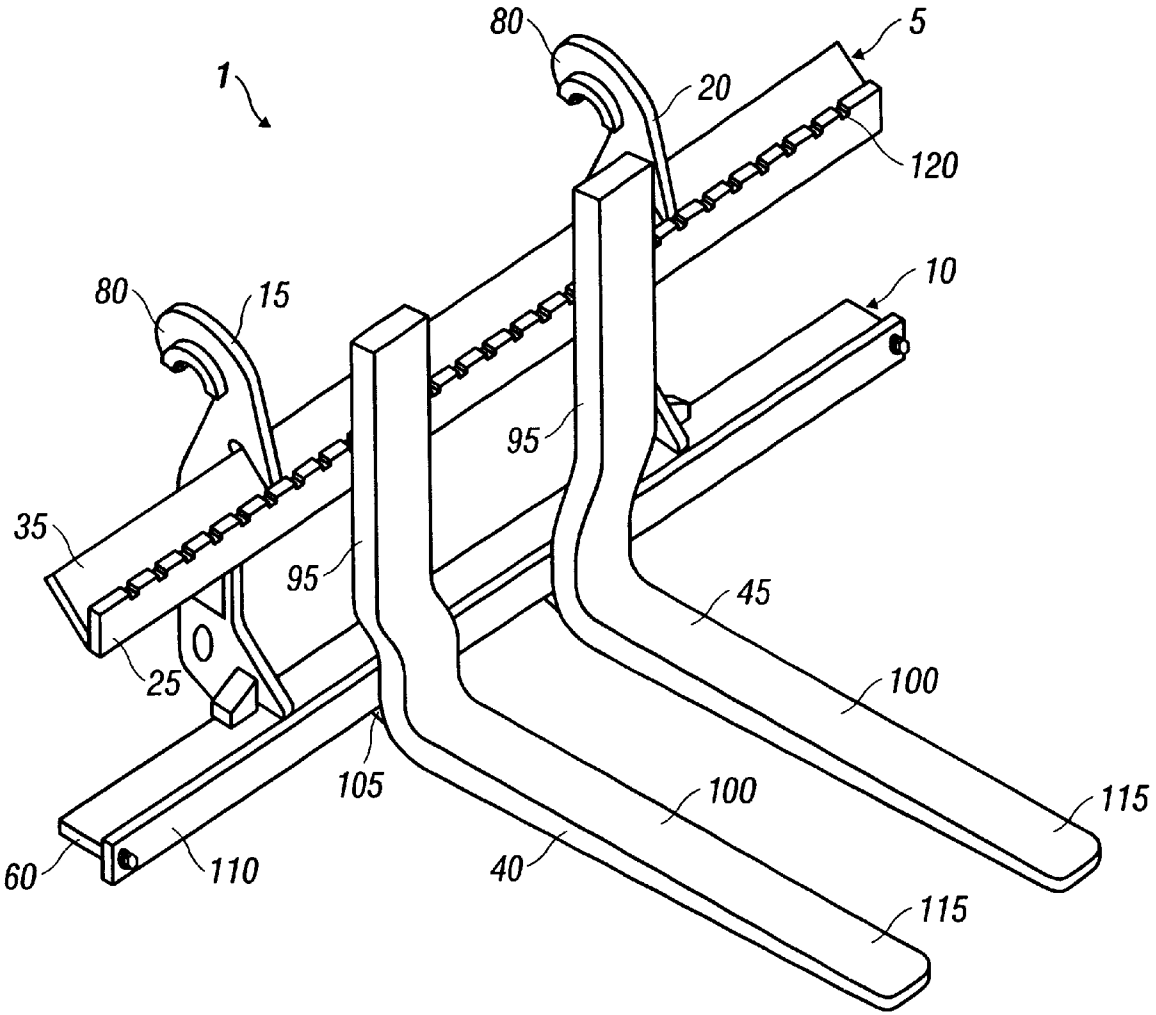
FIG. 1 shows a perspective view of a lift fork rack with fork members mounted on the rack.
Figure 2:
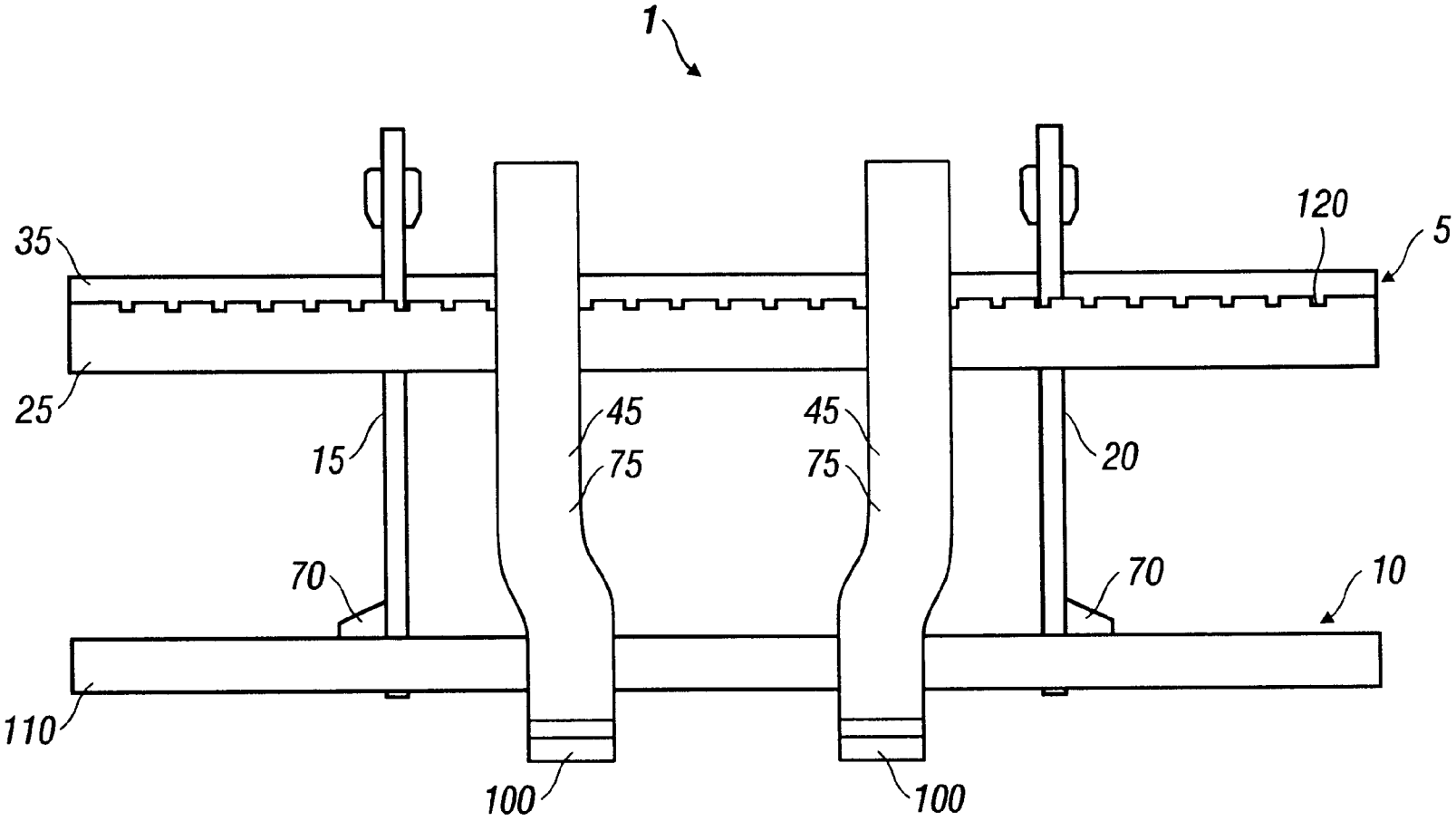
FIG. 2 shows a front view of a lift fork rack with fork members mounted on the rack.

FIGS. 1–4 show a lift fork rack 1, which comprises an upper beam 5 and a lower beam 10, which are fixed spaced from and essentially parallel to each other by means of two spacer elements 15, 20. The upper beam 5 has a flange 25 provided with a web 35. The lower beam 10 is a T-beam. For strength considerations it is important that the anchoring points of the upper and lower beams 5,10 to the respective spacer elements 15, 20 be arranged at a substantial distance from each other. This means, however, that the upper beam 5 will limit the field of vision of an operator of the vehicle on which the lift fork rack 1 is mounted. In order to solve this problem, the web 35 of the upper beam 5 is made inclined, which means that the flange 25 will be displaced relative to the second beam 10. The upper beam 5 has a cross-section substantially in a V-shape. This means that the web is joined to the flange 25 of the upper beam 5 at an angle $\alpha$ which is not 90°. Preferably this angle $\alpha$ lies in the interval 40°–50°. The web 35 is directed into the respective spacer elements 15, 20 and the flange 25 is free of the respective spacer elements 15, 20.

By virtue of the fact that the flange 25 is displaced towards the lower beam 10, the field vision of the operator is increased. The operator is provided with a larger overview of the fork members 40,45 mounted on the lift fork rack 1, making it easier for the operator to aim the fork members 40,45 under the object to be lifted and to place the object where it is to be left.

Figure 3:
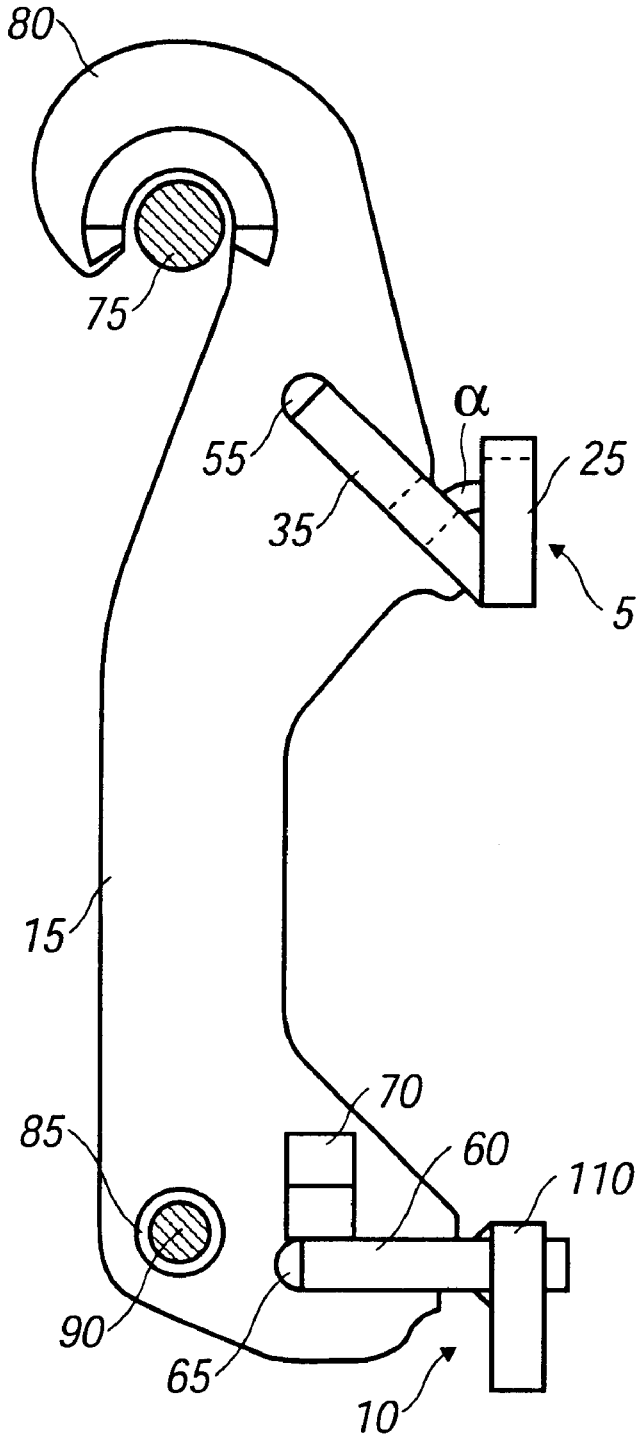
FIG. 3 shows a side view of a lift fork rack.
Figure 4:
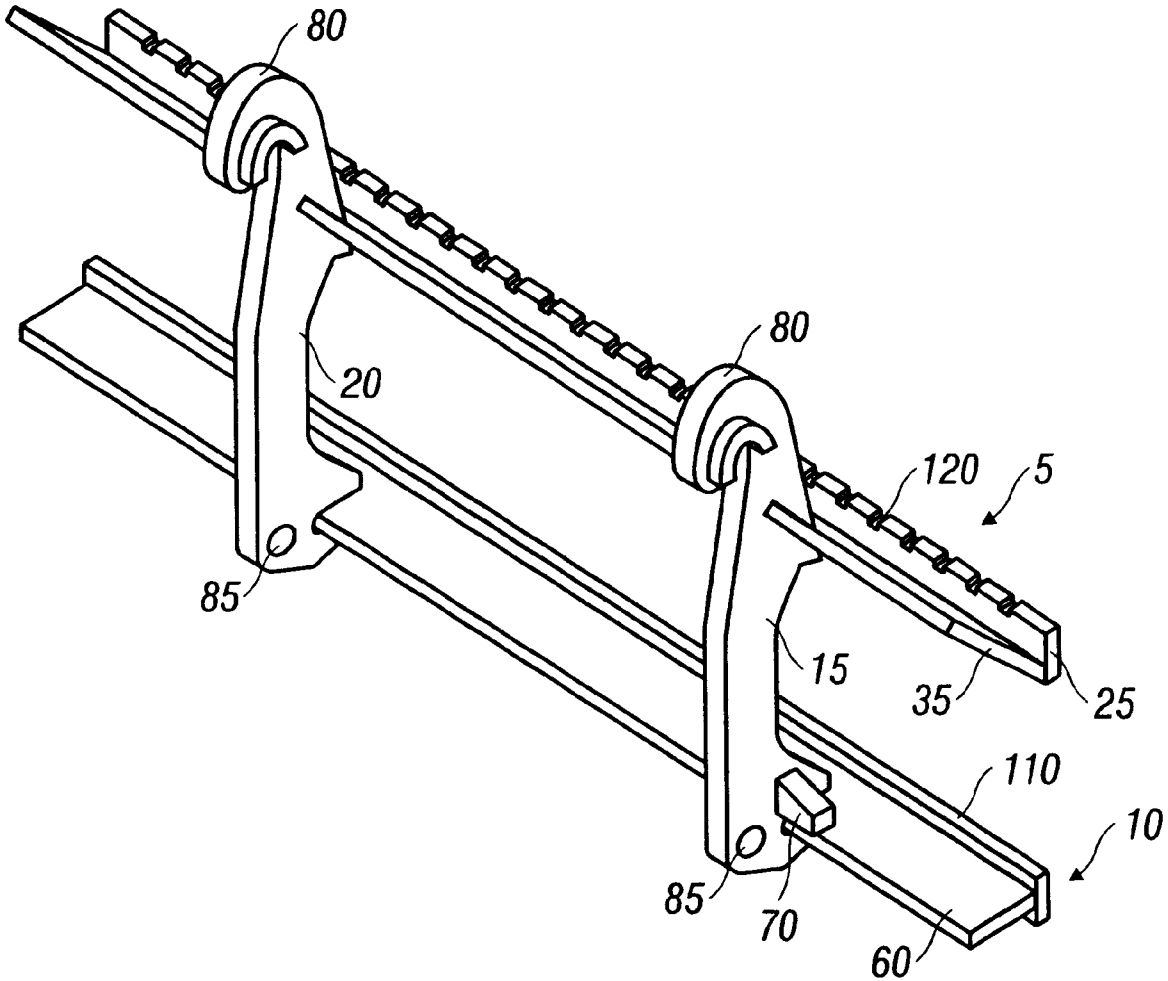
FIG. 4 shows a perspective view of a lift fork rack.

As can best be seen in FIGS. 3 and 4, the upper beam 5 is joined to the respective spacer elements 15, 20 by means of the web 35. The web 35 of the upper beam 5 is inserted into a slot 55 in each spacer element 15, 20. This joint provides high fatigue strength in the joint between the upper beam 5 and the spacer elements 15, 20. The fatigue strength can be increased further by rounding the bottom of the slot 55.

The web 35 of the upper beam 5 thus extends obliquely upwards towards the hook 80, and the flange 25 of the upper beam 5 substantially extends in a vertical plane. Vertical plane in this context means the plane perpendicular to a horizontal surface on which there rests, for example, a pallet to be lifted by means of the lift fork rack.

The lower beam 10, which is made as a T-beam, has a web 60 which is joined to the respective spacer elements 15, 20. A second slot 65 is made in each spacer element 15, 20 into which the web 60 is inserted. In order to reduce the concentrations of stress, the bottom of the second slot 65 is rounded. A heel 70 is arranged on each spacer element 15, 20 and is joined both to the web 60 and to the respective spacer elements 15, 20.

The spacer elements 15, 20 are arranged at a substantial distance from each other and form together with the upper and lower beam 5,10 a frame. The distance between the spacer elements 15, 20 is also dependent on the design of the lifting mechanism 75 to which the lift fork rack 1 is to be coupled.

Each spacer element 15, 20 comprises attachment means in the form of a hook 80 and an opening 85. The hook 80 is designed to be hooked on a lifting mechanism 75 which has a pin 90 designed to be inserted into the opening 85 (FIG. 3).

As can best be seen in FIG. 1, on the Lift fork rack 1 there are preferably mounted two fork members 40,45, such as pallet fork members, each having first and second legs 95, 100. The first 95 and the second 100 legs form essentially a right angle with each other, the first leg 95 having coupling means 105 for coupling together with the upper and lower beams 5,10 of the lift fork rack 1. The coupling means 105 is joined to the first leg 95 and is coupled to the flange 25 of the upper beam 5, and the first leg 95 at the same time abuts against the flange 110 of the lower beam 10. The second leg 100 has a load surface 115 for carrying a load.

In order to be able to lift objects of different shapes, the distance between the fork members 40,45 can be changed. The flange 25 of the upper beam 5 comprises a plurality of notches 120 along its length. These notches are intended to determine the positions of the fork members 40,45 and cooperate with the coupling means 105 to fix the fork members 40,45 laterally. If, for example, long objects are to be lifted, it is suitable that the distance between the fork members 40,45 be great to distribute the load. Preferably both the upper and the lower beams 5,10 extend laterally to either side of each spacer element 15, 20 to make possible a large distance between the fork members 40,45. If smaller objects are to be lifted, the distance between the fork members 40,45 should be small. When the distance between the fork members 40,45 is small, the field of vision of the operator will be limited by the first legs 95 of the fork members 40,45. In order to solve his problem, the first and second legs 95,100 extend in separate vertical planes. The fork members 40,45 being designated such that the distance between the first legs 95 is greater than the distance between the second legs 100, when the two forks are mounted in place on the rack.

Figure 5:
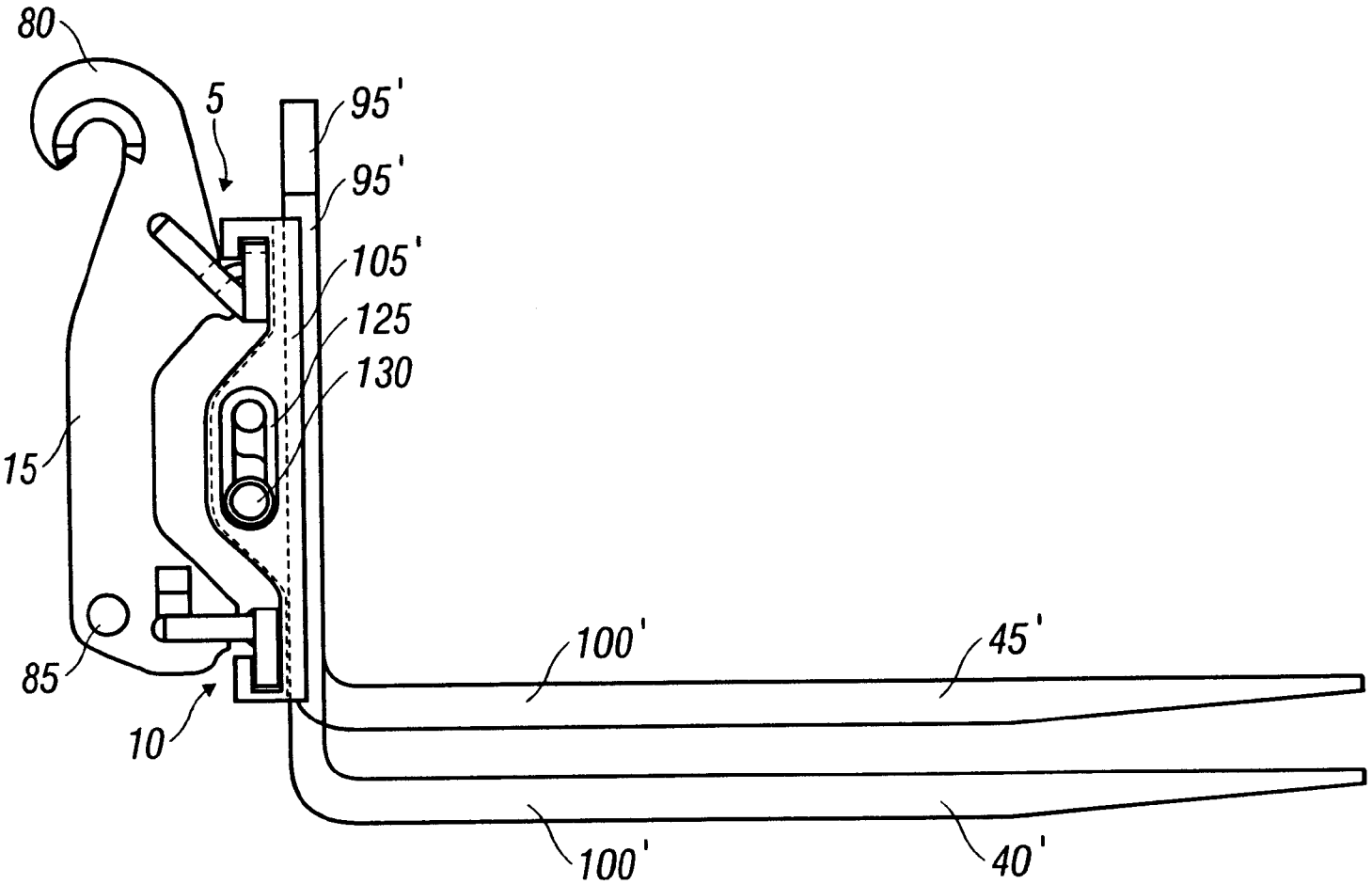
FIG. 5 shows a side view of an alternative embodiment of a lift fork rack with fork members mounted on the rack and being displaceable relative to a coupling means.

According to an alternative embodiment, which is shown in FIG. 5, the respective fork members 40', 45' can be made displaceable relative to the coupling means 105' in the longitudinal direction of the first leg 95'. The coupling means 105' is coupled to the upper and the lower beams 5,10. The coupling means 105' has an elongated opening 125 in which a pin 130 mounted on the first leg 95' can move. This arrangement enables the fork members 40', 45' to be inserted under an object which is placed on an inclined surface without having to tip the entire lift fork rack 1 to the same inclination as the surface. When the lift fork rack 1 with the fork members 40', 45' is lowered against the inclined surface, one of the fork members 40', 45' will strike the surface before the other fork member 40', 45' does. The fork 40', 45' which first strikes the surface will be displaced relative to the coupling means 105' and thus also relative to the lift fork rack 1. When the lift fork rack 1 is lowered further, the other fork member 40', 45' will strike the surface. Thereafter the lowering of the lift fork rack 1 will cease and the fork members 40', 45' will be pushed in under the object to be lifted. FIG. 5 shows the fork members 40', 45' in staggered position. Second legs 100' are also shown in FIG. 5.

What is claimed is:

1. A lift fork rack, comprising:

an upper beam;

a lower beam;

at least two spacer elements which fix the upper and lower beams at a distance from and essentially parallel to each other;

load-bearing fork members mountable on the upper and lower beams, the fork members being displaceable along a length of the upper and lower beams;

the spacer elements comprising connectors configured to releasably attach the lift fork rack to a lift mechanism;

the upper beam having a web and a flange angularly joined together so that the upper beam has a substantially V-shaped cross-section;

the upper beam is joined to each spacer element via the web and the web is directed away from the lower beam.

2. A lift fork rack according to claim 1, wherein the flange extends transversely to its longitudinal direction substantially in a vertical plane.

3. A lift fork rack according to claim 1, wherein the web of the upper beam is inserted in a slot which is arranged in each of spacer element.

4. A lift fork rack according to claim 1, wherein the flange has a plurality of notches along its length to determine the position of the fork members.

5. A lift fork rack according to claim 1, wherien the lower beam is T-beam.

6. A lift fork rack according to claim 1, wherein said flange is substantially flat and extends in a substantially vertical plane.

7. A lift fork rack according to claim 1, wherein said web is substantially flat.

8. A lift fork rack according to claim 1, wherein said web is inclined in relation to said flange at an angle $\alpha$ in a range of 20 to 70 degrees.

9. A lift fork rack according to claim 1, wherein said web is inclined in relation to said flange at an angle $\alpha$ in a range of 30 to 60 degrees.

10. A lift fork rack according to claim 1, wherein said web is inclined in relation to said flange at an angle $\alpha$ ina range of 40 to 50 degrees.

11. A lift fork rack according to claim 1, wherein said web has a larger width than said flange.

12. A lift fork rack, comprising:

an upper beam and a lower beam, said upper and lower beams being configured to carry load bearing fork members;

at least two spacer elements fix said upper and lower beams at a distance from and essentially parallel to each other; and said upper beam being formed by a web and a flange that extend in a longitudinal direction of said upper beam, said flange forming a front portion of the upper beam and being configured to carry load bearing fork members and said web being joined to said flange and directed backwards and upwards from the flange.

13. A lift fork rack according to claim 12, wherein said flange is substantially flat and extends in a substantially vertical plane.

14. A lift fork rack according to claim 12, wherein said web is substantially flat.

15. A lift fork racj according to claim 14, wherein said web is inclined in relation to said flange at an angle $\alpha$ in a range of 20 to 70 degrees.

16. A lift fork rack according to claim 14, wherein said web is inclined in relation to said flange at an angle $\alpha$ in a range of 30 to 60 degrees.

17. A lift fork rack according to claim 14, wherein said web is inclined in relation to said flange at an angle $\alpha$ in a range of 40 to 50 degrees.

18. A lift fork rack according to claim 12, wherein said web has a larger width than said flange.

19. A lift fork rack according to claim 12, wherein said upper beam has a V-shaped cross-section.

20. A lift fork rack according to claim 12, wherein said spacer elements are connected to said flange of said upper beam.

21. A lift fork rack according to claim 12, wherein said web of said upper beam is inserted in a slot arranged in each spacer element.

22. A lift fork rack according to claim 12, wherein said flange has a plurality of notches located along a length thereof and configured to be used to determine positioning of associated fork members.

23. A lift fork rack according to claim 12, wherein said lower beam is a T-shaped beam.

* * * * *